US006609576B1

(12) United States Patent
Hubbard

(10) Patent No.: US 6,609,576 B1
(45) Date of Patent: Aug. 26, 2003

(54) METHOD AND APPARATUS FOR VIBRATORY KINETIC ENERGY GENERATION AND APPLICATIONS THEREOF

(76) Inventor: Melvin Hubbard, 28286 Greenwald Ave., Parris, CA (US) 92570

( * ) Notice: Subject to any disclaimer, the term of this patent is extended or adjusted under 35 U.S.C. 154(b) by 0 days.

(21) Appl. No.: 09/724,697

(22) Filed: Nov. 28, 2000

(51) Int. Cl.[7] ..... E21B 7/00

(52) U.S. Cl. ..... 173/1; 173/49; 173/184; 173/100

(58) Field of Search ..... 173/1, 49, 184, 173/100

(56) References Cited

U.S. PATENT DOCUMENTS 3,770,322 A * 11/1973 Cobb et al. ..... 299/37
3,868,145 A 2/1975 Cobb et al.
3,909,149 A 9/1975 Century
3,935,712 A 2/1976 Erickson et al.
3,958,613 A * 5/1976 Herz ..... 144/24.12
4,058,258 A * 11/1977 Rosen et al. ..... 118/306
4,067,369 A * 1/1978 Harmon ..... 144/24.12
4,211,121 A * 7/1980 Brown ..... 74/87
4,352,023 A * 9/1982 Sachs et al. ..... 290/42
5,039,252 A * 8/1991 Schuermann ..... 405/182
5,088,565 A * 2/1992 Evarts ..... 173/49
5,330,011 A * 7/1994 Powell ..... 173/1
5,437,341 A * 8/1995 Horn et al. ..... 175/122
5,458,204 A * 10/1995 Tünkers ..... 173/49
5,596,824 A * 1/1997 Scott et al. ..... 37/403
5,658,091 A 8/1997 Goughnour et al.
5,746,277 A * 5/1998 Howell, Jr. ..... 173/147
5,875,685 A * 3/1999 Storaasli ..... 343/757
6,234,718 B1 * 5/2001 Moffitt et al. ..... 405/182

* cited by examiner

*Primary Examiner*—Rinaldi I. Rada
*Assistant Examiner*—Thanh Truong
(74) *Attorney, Agent, or Firm*—Mark D. Wieczorek

(57) ABSTRACT

A device and method for performing a task employing vibration of a tool. The device includes a housing containing at least one off-center weight, and the off-center weight is coupled to a motor and configured to rotate or revolve to vibrate the housing. The housing further includes a device mount to allow the housing to be removably coupled to a mount on a vehicle. A tool is removably coupled to the housing via a socket on the housing to perform a task. The housing may be coupled to a plurality of types of vehicles and is such that a plurality of types of tools may be coupled to the housing.

2 Claims, 22 Drawing Sheets

METHOD AND APPARATUS FOR VIBRATORY KINETIC ENERGY GENERATION AND APPLICATIONS THEREOF

CROSS-REFERENCE TO RELATED APPLICATIONS (NONE)

REFERENCE TO GOVERNMENTAL SUPPORT (NONE)

REFERENCE TO MICROFICHE APPENDIX (NONE)

FIELD OF THE INVENTION

The present invention relates to vibratory motion machines, and more particularly to vibratory motion machines having modular components.

BACKGROUND OF THE INVENTION

The construction industry in the United States includes highway construction and maintenance, building construction and maintenance, mining, dams, machinery rental, agencies, etc., that contribute to the national infrastructure. Analogues may be seen around the world. These areas are expanding and must be continually upgraded and maintained.

For example, the U.S. Transportation Equity Act, which became law on Jun. 9, 1998, calls for $217,000,000,000 to be spent over six years to upgrade the national infrastructure. $5,000,000,000 is estimated to be the cost to rebuild the war-ravaged country of Kosovo. Both of these massive efforts will require high quality, efficient, and modular construction equipment to be employed.

Present heavy machine equipment is generally not modular. For example, a different prime mover and set of tools may be placed on a typical tractor but the prime mover and set of tools within the set do not vary a great deal. For example, the prime mover may be of different sizes or some tools of a different shape. However, they typically cannot be said to accommodate a truly wide range of tools. In other words, most devices currently attached to, e.g., tractors, are dedicated tools. Moreover, the tools so provided may or may not be efficiently driven by the prime mover.

Sonic devices have been employed in certain instances. However, these have limitations such as material fatigue due to high frequency molecular vibrations, as well as limited frequencies of operation.

SUMMARY OF THE INVENTION

The present invention overcomes the disadvantages of the prior art noted above.

In one aspect, the invention is related to a device for performing a task employing vibration of a tool. The device includes a housing containing at least one off-center weight, and the off-center weight is coupled to a motor and configured to rotate or revolve to vibrate the housing. The housing further includes a device mount to allow the housing to be removably coupled to a mount on a vehicle. A tool is removably coupled to the housing via a socket on the housing to perform a task. The housing may be coupled to a plurality of types of vehicles and is such that a plurality of types of tools may be coupled to the housing.

Implementations of the invention may include one or more of the following. The tool may be selected from the group consisting of: bores, augers, cable layers, trenchers, blades, shakers, rollers, planars, grinders, tillers, rakes, tampers, grid layers, scarifiers, conveyors, winches, scrapers, mixers, shaker screens, corers, destruction tools, drills, cutters, double line cutters, pipe cleaners, and combinations thereof.

In another aspect, the invention is directed towards a method of performing a task employing vibration of a tool. The method includes providing a housing containing at least one off-center weight, the off-center weight coupled to a motor and configured to rotate or revolve to vibrate the housing; removably mounting the housing via a device mount to a mount on a vehicle; removably mounting a tool to the housing via a socket on the housing, to perform a task; and rotating or revolving the off-center weight.

The present invention has numerous advantages over prior systems. The present invention employs an adjustable amplitude that can be much greater than that achieved with sonic, e.g., ultrasonic, devices. The force achieved is employable in a variety of applications. The present invention achieves less tool fatigue than that that would be endured in sonic devices. The present invention may be employed at numerous frequencies, unlike sonic devices. In fact, the only limitation on the frequency is the desire of the user, as well as the material limitations of the particular tool. For example, rock may break at numerous frequencies, while asphalt only one. Further, compaction of soil varies with the soil and depth; however, if too much energy is applied, the soil may "resound" and defeat compaction. The present invention allows such factors to be overcome.

The work of the device is accomplished primarily by the oscillation of the vibratory device. For example, in an asphalt-cutting tool, a blade may move forward into asphalt due to an amplitude of motion of the vibratory device. The amplitude and direction may then reverse, traveling "backward" during which time the tractor or other vehicle moves forward, moves forward, advancing the blade into a new and "fresh" cutting position. The process may, in one scenario, be repeated 2000 times per minute. Due to inertia, the process may appear to be continuous.

Advantages of the invention may include one or more of the following. The invention may be modular and may allow use of a number of different tools. The invention generates a large amount of vibratory energy to assist the tool in performing the desired function. The invention may be made sufficiently small to allow use in a wide variety of work environments. The invention may allow a tool to operate with enhanced force, speed, or a combination of the two. The invention may be easily adapted to retrofit on almost any current tractor or crane or taxtavator, etc. The invention may employ a relatively low horsepower motor but still be self-propelling in the sense that the device may be moved by a contained engine and the engine may further be used to drive another device, e.g., via hydraulics. The device may employ relatively easy to repair components such as belts, in lieu of or in addition to more difficult to repair components such as gears. The device may be easy to rotate and easy to swivel horizontally or vertically via a gimbel. The above noted hydraulics may be employed to move the device on the gimbel. The device may employ a ratcheted or stepper motor to allow the device to drive drill tools, planers, trenchers, etc. Other such driven tools are described below in more detail. The amplitude of vibration of the device may be easily changed by changing the drive pulley. Similarly, the belt pulley ratio may be easily so changed.

Other advantages will be apparent from the description that follows, including the figures and the claims.

BRIEF DESCRIPTION OF THE DRAWINGS

FIG. 11 shows a plate tamper which may be implemented with an embodiment of the present invention.

DETAILED DESCRIPTION OF THE PREFERRED EMBODIMENTS

Figure 1:
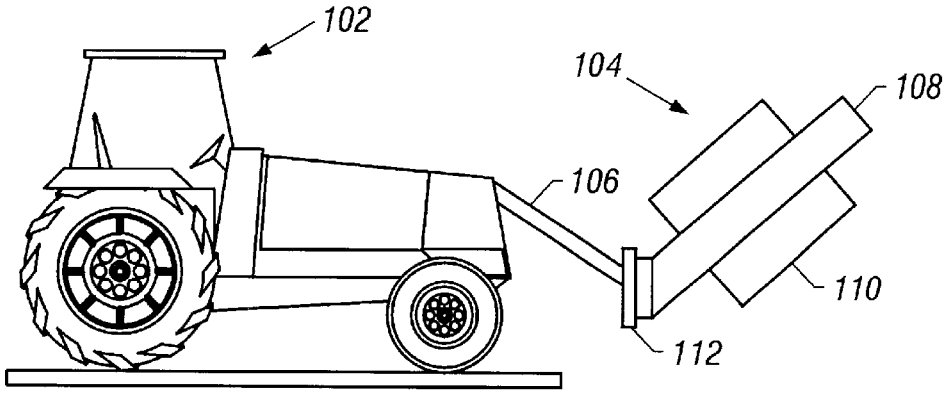
FIG. 1 is a schematic side view of a tractor and device according to an embodiment of the present invention.
Figure 2:
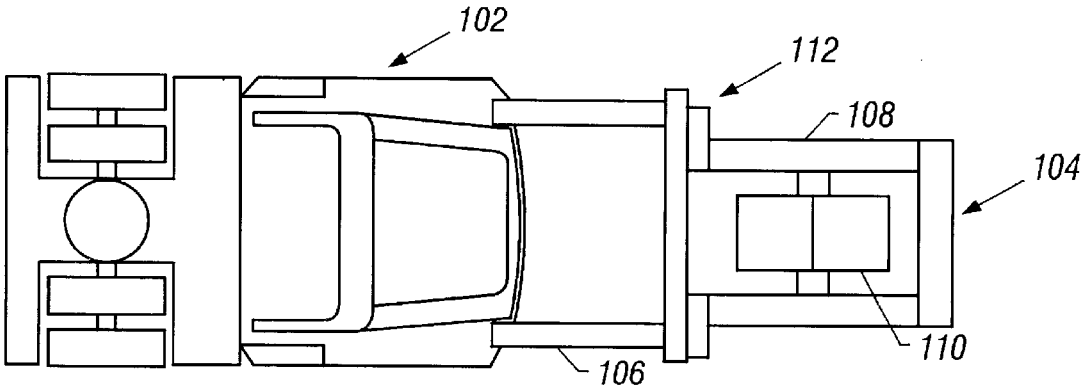
FIG. 2 is a schematic top view of the tractor and device according to the embodiment of FIG. 1.
Figure 1A:
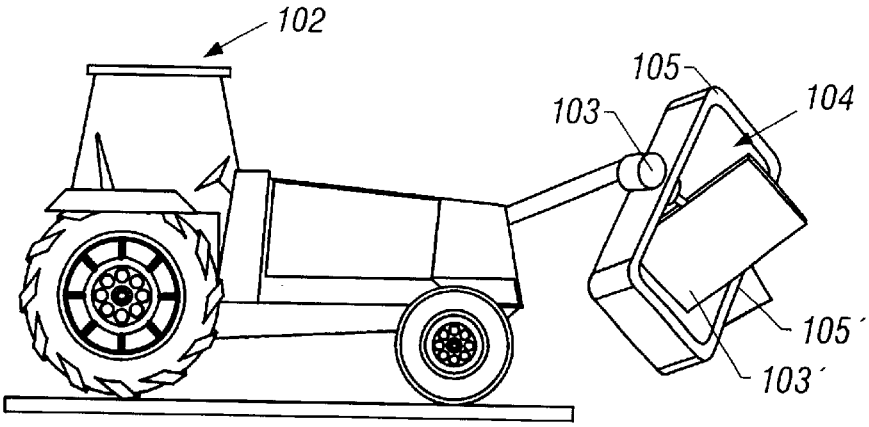
FIG. 1A is a pictorial perspective view of a tractor and device according to an embodiment of the present invention.

FIGS. 1, 1A and 2 show schematic side and top views of a tractor and device according to an embodiment of the present invention. In particular, a tractor 102 is shown connected to a vibratory device 104 via a boom 106. The boom 106 is connected to the vibratory device 104 via a mount 112. The vibratory device 104 includes a support structure 108 and a vibratory box 110. These aspects, as well as other aspects, are now discussed in more detail.

Figure 4:
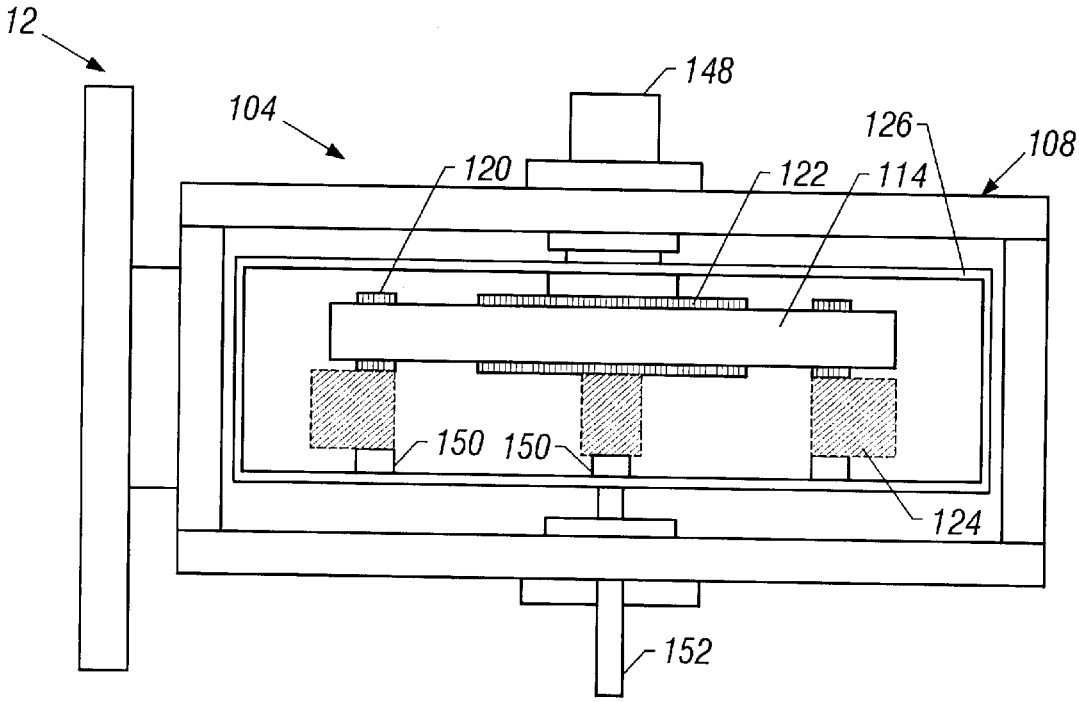
FIG. 4 is a schematic top view of a vibratory device according to an embodiment of the present invention.
Figure 3:
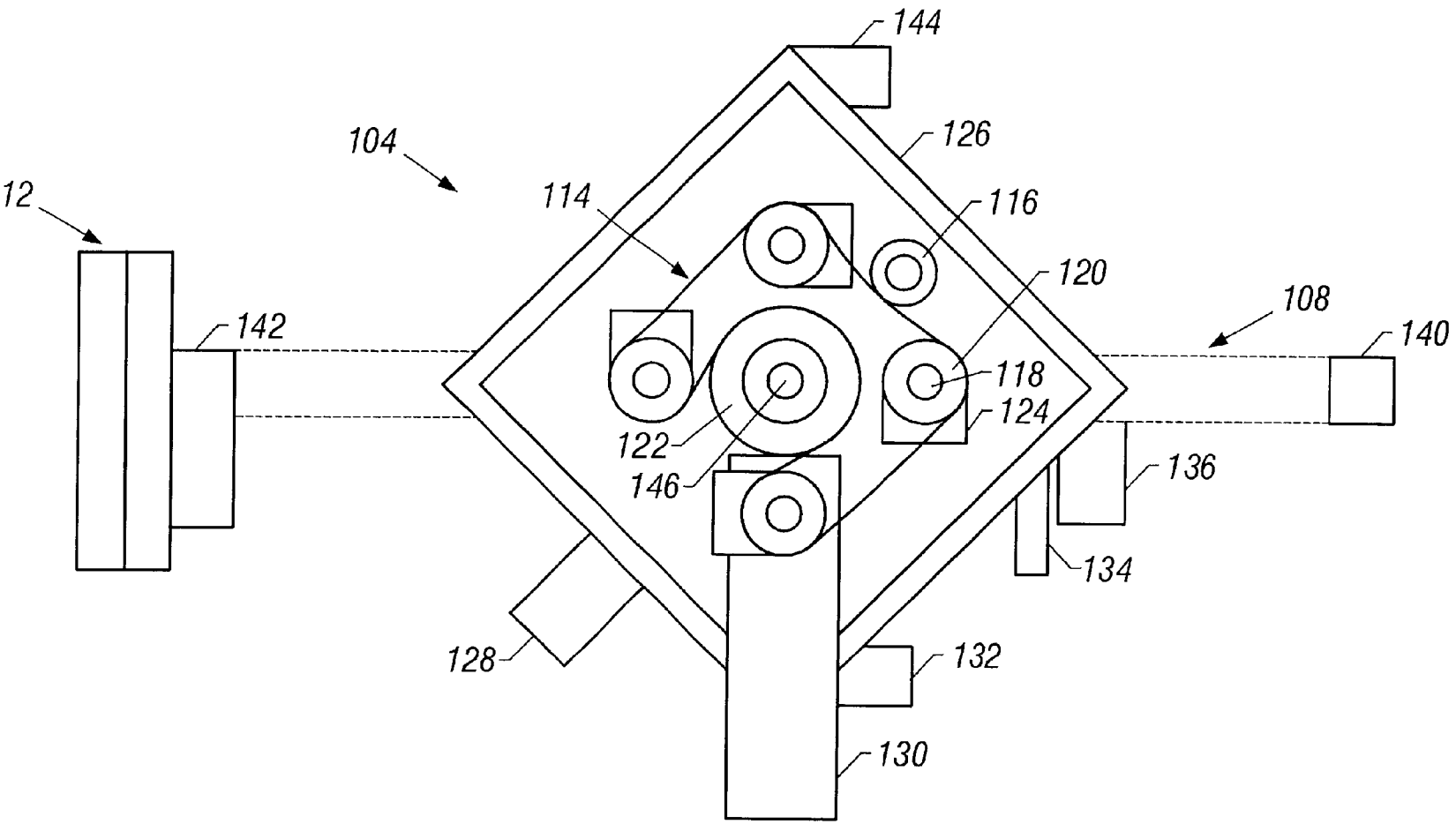
FIG. 3 is a schematic side view of a vibratory device according to an embodiment of the present invention.

Referring to FIGS. 3 and 4, in which side and top views, respectively, of the vibratory device 104 are shown schematically, the mount 112 is shown connected to the vibratory box 110 via support structures 103 and 105 (see FIG. 1A), each of which is a housing that allows independent movement of the vibratory device 104 about axes 103' and 105', respectively. In particular, support structure 105 provides an inner frame and support structure 103 provides an outer frame. Other mounts may also be used as are known in the art.

The location of the tool mounting may affect the operation of the tool and the decision on which tool to use. For example, if using a vibrating roller, discussed below, the far front end of the device may be used, allowing vertical movement up and down and allowing the tractor's hydraulic boom to put downward pressure on the roller as well. Conversely, if an asphalt cutter blade is used, the best position may be to mount the same on the bottom of the vibratory device (see, e.g., FIG. 8 below).

The vibratory box 110, that may be used in many different positions, includes a housing 126 in which are included a number of hubs 120, rotating on a corresponding number of axles 118, to which are attached a corresponding number of off-center weights 124. The housing 126 may be constructed of stock materials. While shown to be roughly square, the same may be rectangular, round, etc.

The off-center weights revolve about the axles 118 at a common angular speed due to a common belt 114, such as a common double-cog belt 114. FIG. 3 also shows a tensioner or idler 116 that may be employed to adjust the tension on the belt 114. The tensioner function is an advantage of the belt system: if the belt is worn and becomes loose, the idler or tensioner may be employed to take up any undesired slack in the belt or allow for different gear ratios and adjust the belt accordingly.

The weights may be timed in balance relative to vibrations exterior of the vibratory device. They may be swiveled, e.g., via a ball socket, to relieve the bearing load from precession as well as from other loads. The weights and the belt generally rotate only inside the housing for safety. The weights may be rotated in either direction.

The belt 114, which may be of a common timing belt design, e.g., a common double-cogged timing belt, may be replaced with a gear system in known fashion if desired. However, the use of the belt 114 may afford a number of advantages. If the belt requires replacement, the same may be changed by simply removing a cover of the housing, sliding the belt off, and replacing the belt. The idler may then be adjusted to conform to the new belt. The use of a timing belt lessens the requirement of strict and exact positioning of the off-center weights, as would otherwise be required in a geared system. The use of a belt also lessens the requirement of lubrication as compared with geared systems. The use of a belt reduces the overall weight of the system, and is generally less expensive than a geared system, especially with respect to changing belt ratios and/or weights. The belt may also be tightened, e.g., via a cam shaft or other such belt tightener.

The off-center weights 124 are revolvably coupled to the vibratory box 110 via a number of journals 150 (FIG. 4). During assembly, a central bulkhead holds the journals, as well as the drive shaft. At the end of the assembly, when a housing cover is being installed, the cover allows for the final alignment of the shafts, journals, and bearings.

The common belt 114 is driven by a drive shaft 146 connected to an appropriately sized hub 122. The drive shaft 146 is powered by a motor 148 (shown in FIG. 4). The motor 148 may be of a number of types, and is described in more detail below. The drive shaft 146 extends to distal portion 152, on which may be mounted a number of tools as described below.

A number of mounts are shown, such as a mount 130, a mount 132, and a mount 144. These may be employed to mount various tools to the vibratory box 110 as is described below. The mounts may employ sockets for mounting tools, such as sockets operated by hydraulic pressure on a cone or ball or the like. The socket mounts may be disposed in various locations for different types of work, tools, amplitudes, or combinations of the above.

It will be clear that numerous variations of this design may be employed to similar effect. For example, one or more off-center weights 124 may be employed. There may be an advantage to having four off-center weights since the same may be approximately evenly distributed over the volume of the vibratory box 110. However, the number and magnitude of weights could be varied in numerous ways. The more equal weights and shafts, the less the bearing load. The assembly may be operated dry or in, e.g., an oil bath.

Figure 5:
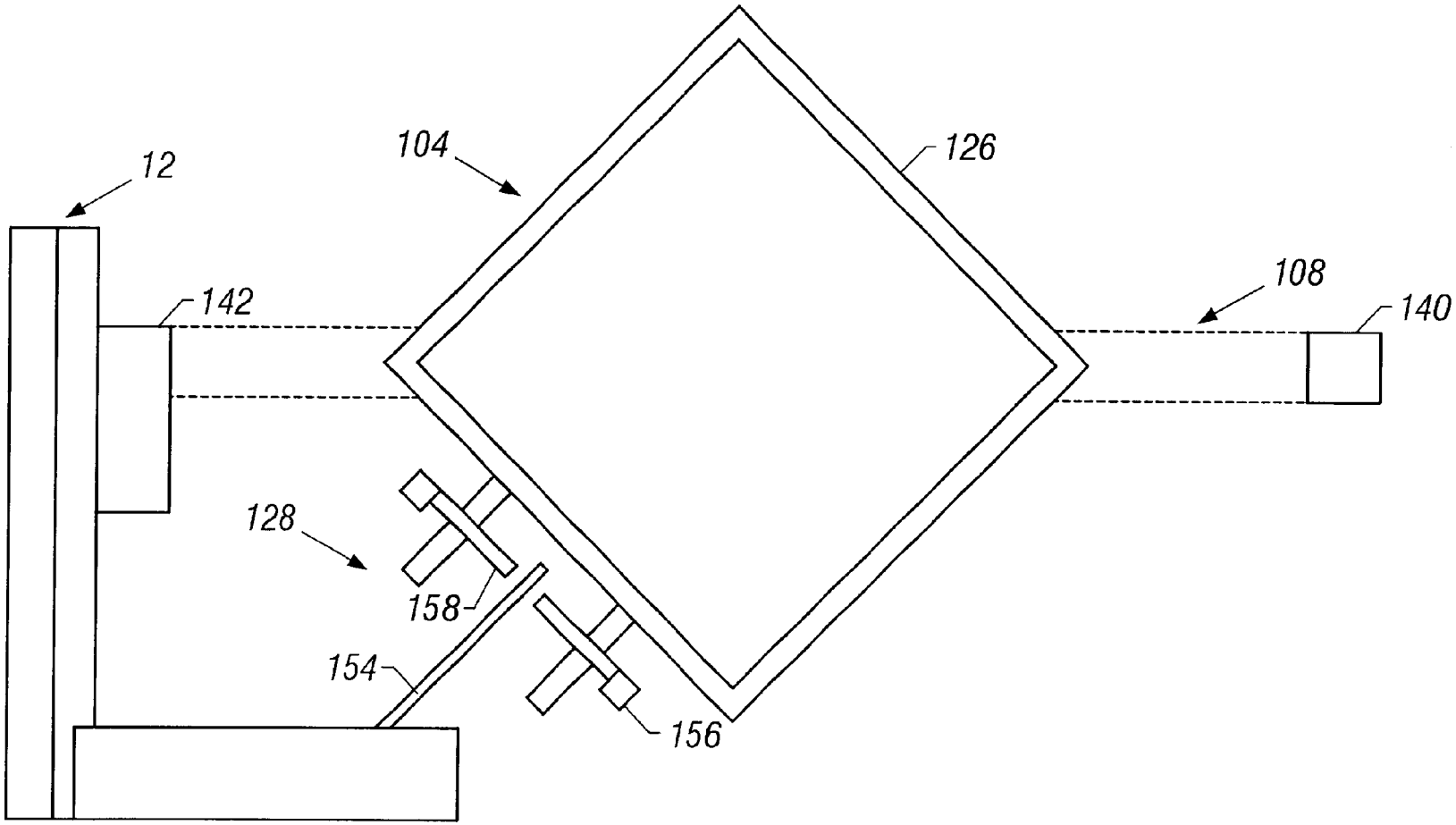
FIG. 5 shows a detail of a leaf spring system according to an embodiment of the present invention.
Figure 6:
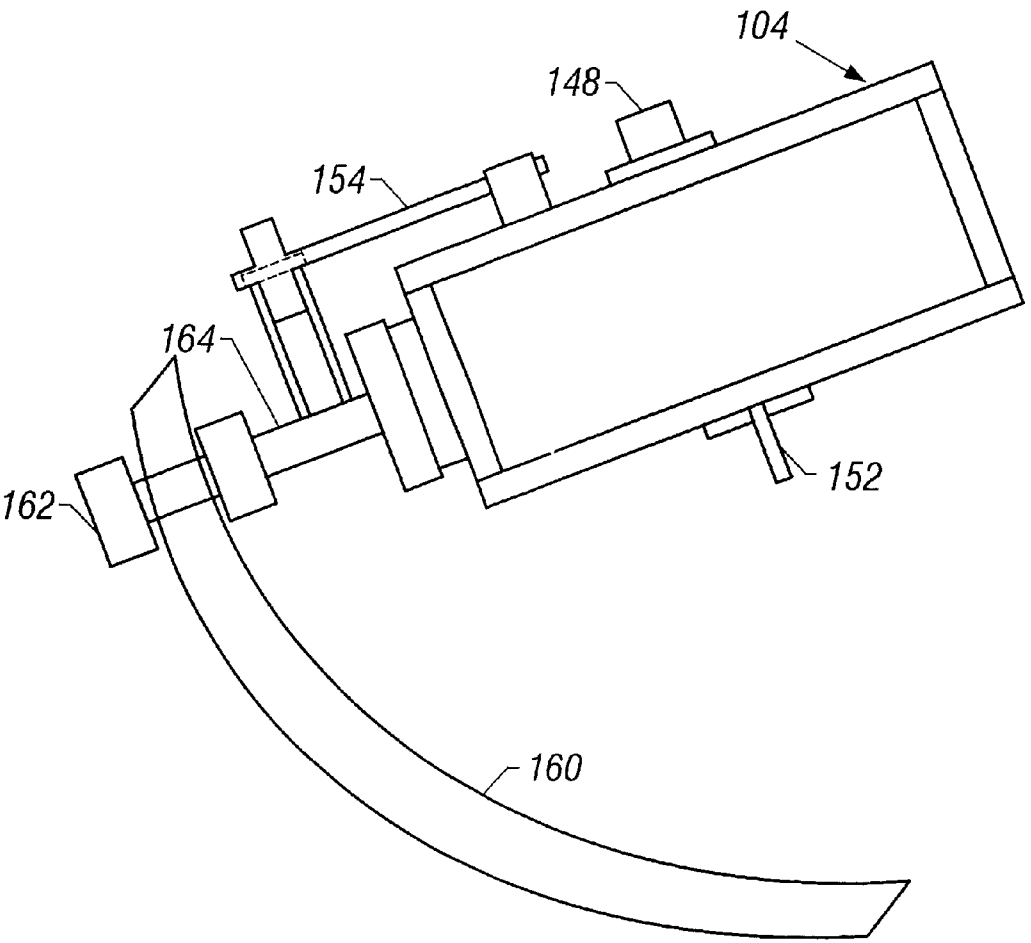
FIG. 6 shows a detail of an arc frame system according to an embodiment of the present invention.

Referring to FIGS. 5 and 6, a leaf spring system 128 is shown. The leaf spring system 128 may be advantageously employed in an embodiment of the invention. The system 128 includes a leaf spring 154 inserted between two points 158 that are movably mounted via a screw adjustment 156. While the leaf spring system 128 is shown in one location with respect to mount 112, the same may be placed at several different locations on the mount. In particular, the leaf spring system may mount to a swiveling portion to allow the leaf spring system to be used in a variety of vibratory device orientations. Of course, the leaf spring system may be disengaged when it is desired to rotate the vibratory device as described in more detail below. Rotation may further be assisted using the ratchet device described in this specification. It may be preferable in many embodiments to mount the leaf spring system to the inner support structure 105.

When the spring is removed, with or without use of the ratchet, the vibratory device may be rotated in either direction to perform various procedures during rotation, e.g., by the addition of tiller blades. Other tools could also be used. Of course, in these embodiments, sufficient clearance for tool rotation must be provided.

The leaf spring system 128 constrains the amplitude of vibration of the vibratory box 110 by a known amount. The leaf spring 154 flexes with the motion of the vibratory box 110, but does not allow the vibratory box 110 to rotate past a set point. By changing the clearance between the points 158 and the leaf spring 154, the amplitude of vibration of the vibratory box 110 may be changed. In an embodiment of the invention in which it is desired to have the vibratory box 110 rotate at a preset angular speed, the leaf spring system 128 may be removed. In other words, by removing the leaf spring 154, the vibratory box 110 can rotated to do work. This facility is discussed below in connection with FIG. 7.

Referring to FIG. 6, embodiment of an arc frame system is shown. The arc frame system allows the vibratory device 104 to be swiveled in either a vertical or a horizontal plane within the support structure 108. In this embodiment, in which is shown primarily a variation on mount 112, an arc frame 160 is shown to which the vibratory box 110 may be mounted. The vibratory box 110 mounts to the arc frame 160 via at least one anchor 162. The anchor 162 may simply be tightened against the arc frame 160 to secure the vibratory box 110 in a desired angular position. Of course, it should be noted that the angle subtended by the arc frame 160 may be much greater, somewhat greater, or less than that shown in FIG. 6. The arc frame system may be situated either vertically, to effect vertical swiveling, or horizontally, to effect horizontal swiveling, depending on the desired position of the vibratory box 110. Two arcs may be employed to allow both motions. Typically, one arc may be employed which is capable of switching between vertical and horizontal movement.

In an application of the arc system, the vibratory device may be mounted within the arc frame system such that the vibratory device remains in a predetermined orientation even if the tractor is moving on a slope. As a corollary, a maintaining plumb may be employed to aid in determining vertical work positions.

Figure 7:
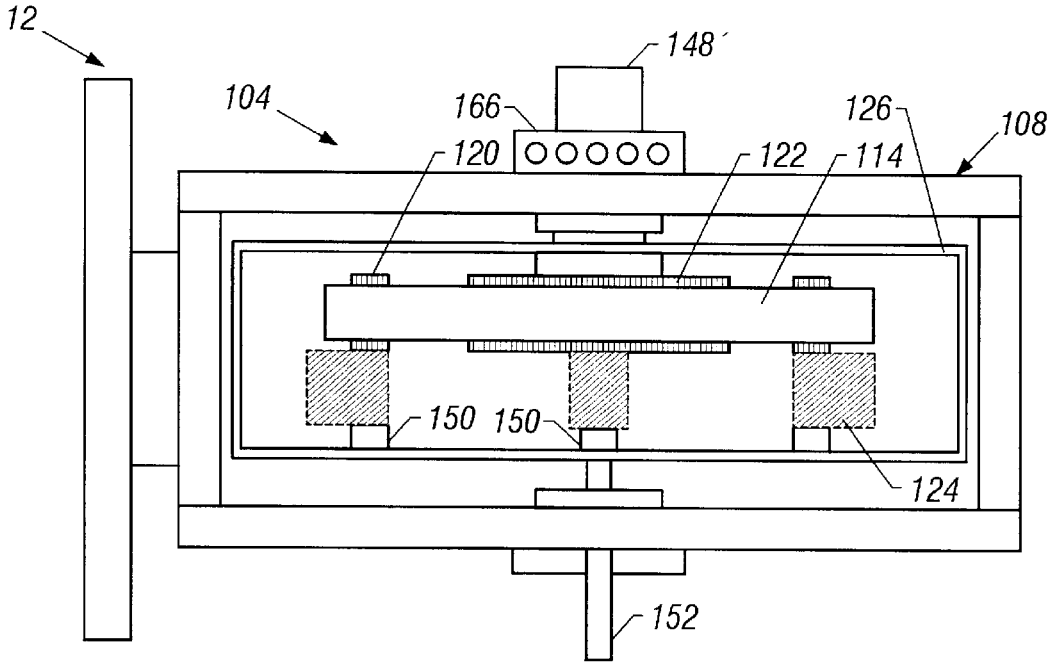
FIG. 7 shows a detail of a ratchet system used according to an embodiment of the present invention.

Referring to FIG. 7, an embodiment of a ratchet gear system used with the invention is shown. In particular, a ratchet gear 166 is shown between a motor 148' and the vibratory box 110. In this embodiment, the leaf spring 154 may or may not be removed. In such a method, the vibration of the vibratory box 110 causes the same to rotate in a back and forth manner. However, the ratchet constrains the box to only acquire a net rotation in one or the other angular direction. In other words, the ratchet is resistant to angular movement in the other direction. It should be noted that in a related embodiment a belt may be run from an axle of the ratchet to yet another shaft. In either case, the driven shaft, if appropriately housed, may rotate in a manner such as may be appropriate to drive a drill or other piece of rotating equipment or to drive the vibratory device itself via, e.g., a belt chain or the like, to make the same self-propelled.

The ratchet 166 may also be mounted independently of the shaft that drives the weights, and can further use its own shaft to establish an oscillation. The ratchet 166 may be used in either direction for positive rotations. By using two ratchets, the same may be clutched in and out for reverse positive rotations of the shaft. Further, a pulley and appropriate mechanisms may be employed to allow the vibratory device to be thus self-propelled. Even further, the ratchet may be, instead of being connected to the drive shaft, may be connected to the axle of the wheels, or to a shaft driven by either the axle or the driveshaft.

The motor 148 is now described in more detail. The motor 148 may be of relatively small horsepower, such as 15 hp, but may still allow the vibratory device to be self-propelling. The motor 148 may be powered using the tractor's normal hydraulic pump system through the hydraulic lines' so-called "quick couplings". The motor 148 may be detachably mounted, such that several different types of motors may be coupled to the vibratory box 110. As noted above, stepper motors or ratchet motors may also be employed.

Applications

Application of vibratory motion greatly facilitates the performance of the tool attached to the vibratory device. In particular, in cutting applications, earth may be cut in thicker layers than previously. Alternatively earth that might not otherwise be capable of cutting may be cut. In such or similar applications, earth is caused to undergo numerous cycles of compression and tension. The applied kinetic energy causes the earth to acquire high mobility, easing entry of the cutting blade into the same. Of course, the above explanation is for descriptive purposes only and should not be construed as limiting the invention. Other explanations are provided below with regard to particular tools. These should similarly not be construed as limiting of the scope of the invention.

Asphalt Cutting

An embodiment of the present invention may be advantageously employed to perform asphalt cutting. In this system, the motor used may be a 60 hp motor operating at 2,000 rpm. Such a system may be capable of generating oscillations of about 650 foot-lbs of force on each stroke.

A typical blade used in an asphalt cutter may be about ⅝ inch thick, 8 inches wide, and 12 inches long. The blade may be of the self-sharpening type.

Figure 8:
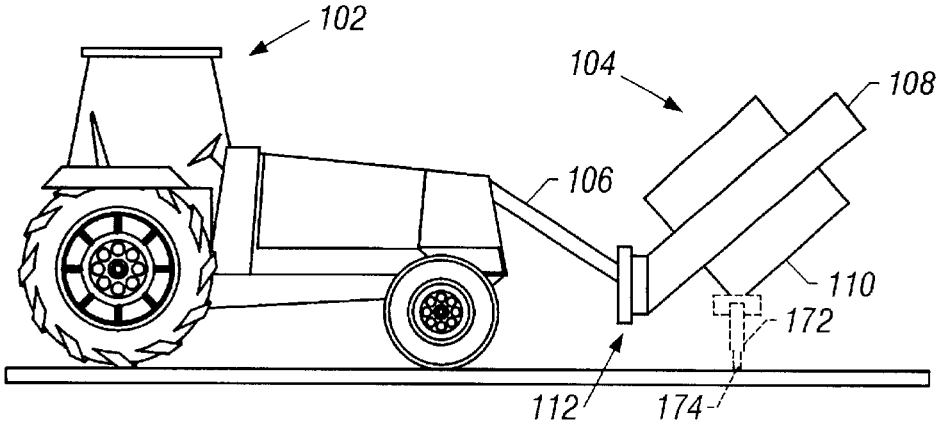
FIG. 8 shows an embodiment of the present invention in which the same is implemented with an asphalt cutter.

An example of an asphalt cutter according to an embodiment of the invention is shown in FIG. 8. In FIG. 8, the tractor 102 is shown attached to the vibratory device 104, which is in turn attached to an asphalt cutter 172 having a blade 174.

Figure 9:
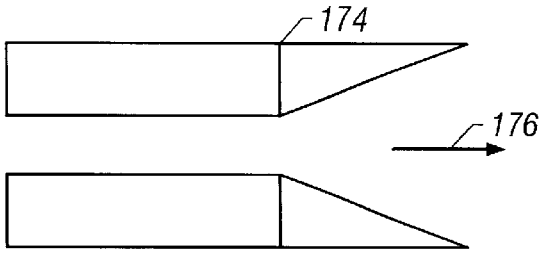
FIG. 9 shows a dual blade system which may be employed in the asphalt cutter of FIG. 8.

FIG. 9 shows a set of blades 174 for use with the asphalt cutter. The blades 174 may be angled as'shown so that cut asphalt falls inward (between the blades) as the blades move in the direction of travel, here indicated as direction 176. This arrangement also helps to make the blades self-sharpening. The blades may be sharpened on either side and may cut in either direction. As the blade wears in width, but still staying sharp, the same may be transferred to the opposite side (if two blades are being used to make two cuts simultaneously). The asphalt cutter blade may be, e.g., a cutting disc instead of a solid blade. A disc, with a shaft and bearing in the center, tends to strike the asphalt below the disc fulcrum, rotating the disc. This allows cooling of the blade and distributes wear around the blade, providing a longer life and sharpness.

Other Analogous Operations

Figure 10:
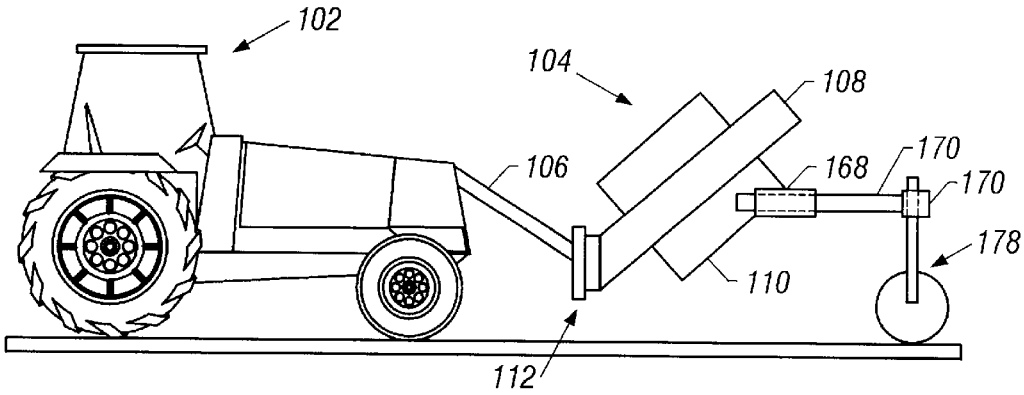
FIG. 10 shows an embodiment of the present invention in which the same is used as a vibrating roller.
Figure 10A:
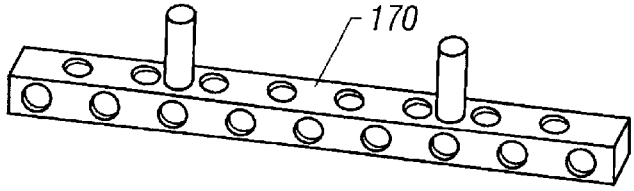
FIG. 10A shows an extension tool which may be implemented with an embodiment of the present invention.
Figure 10B:
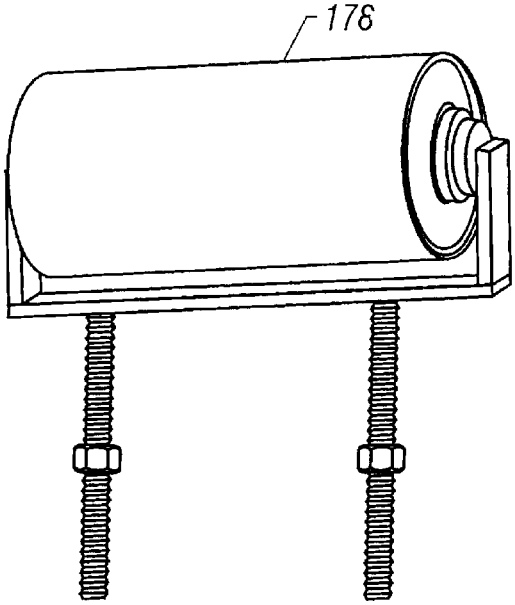
FIG. 10B shows a roller which may be implemented with an embodiment of the present invention.

By switching the tool that is attached to the extension tool 170 (seen in FIG. 10A, for example), a variety of other mechanical operations can be performed. For example, by switching with a roller 178, a vibrating roller may be formed (FIGS. 10 and 10B). The extension tool 170 connects the vibratory box 110 with the tool. The extension tool 170 connects to the vibratory box 110 via a connector 168. The connector 168 may be a simple fitting in which the extension tool 170 may be placed. In this case, it is preferable that the connector 168 have means within to tighten the extension tool 170 against movement in the direction of the longitudinal axis of the extension tool 170.

Referring back to the vibratory roller, the same may mount on bearings and a shaft and may have varying widths and arm lengths. Also, in lieu of an "arm", the same may mount directly to the vibratory device. In fact, most of the tools described herein may be mounted either to the device directly or to the device via, e.g., the extension tool 170. The motion of the vibratory roller is provided by the vibratory device 104 as well as by the tractor moving back and forth over the soil or trench while creating downward pressure using the tractor's hydraulic boom.

Figure 11:
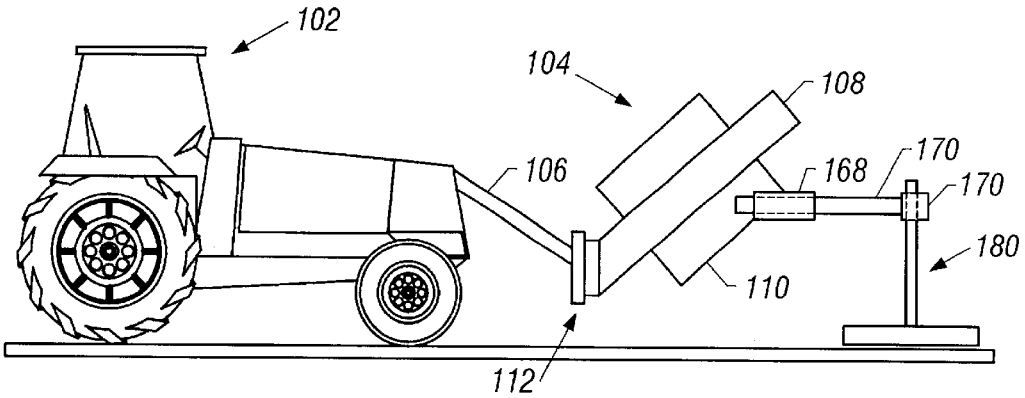
FIG. 11 shows an embodiment of the present invention in which the same is implemented with a plate tamper.
Figure 11A:
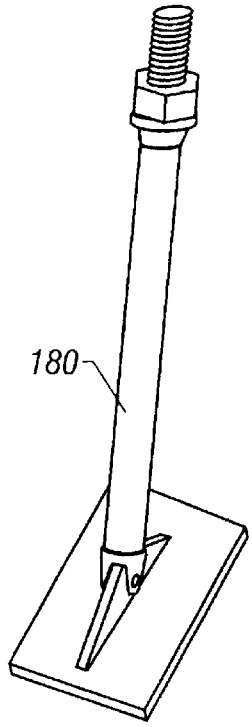

By switching with a plate 180, a plate tamper may be formed (FIGS. 11 and 11A), or with two such plates, the amount of work performed can be doubled. To mount two plates, opposite sides of the drive shaft, e.g., those on opposite ends of a diagonal across vibratory box 110, may be used. Various length shafts may be employed, and the same may be mounted to a plate, which can also have various sizes. The plate 180 may be swiveled at the shaft end connection. The mounts may be varied to affect the length of the shaft's "strike". When tamping soil in trenches, different length shafts may be employed to allow different depth trenches to be tamped. Downward pressure may be applied via the tractor's hydraulic boom, this last feature applicable to various other tools described herein as well.

Figure 12:
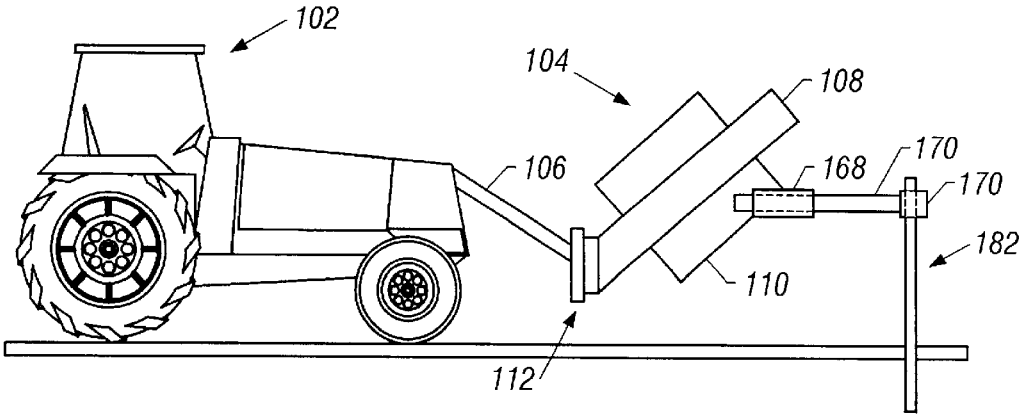
FIG. 12 shows an embodiment of the present invention in which the same is implemented with a destruction tool.
Figure 22A:
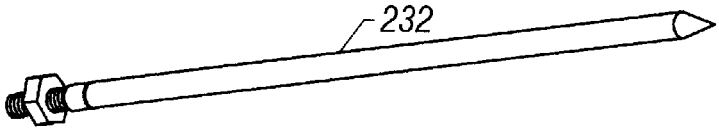
FIGS. 22A and 24A show destruction tools which may be implemented with an embodiment of the present invention.
Figure 24A:
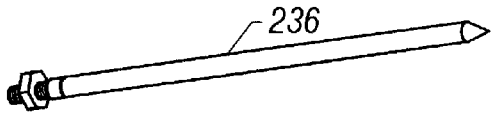

By switching with a blunt but strong blade-like tool 182, a vertical concrete breaker or destruction tool may be formed (FIG. 12 and FIG. 22A). In particular, vertical or horizontal destruction tools 232 may mount to various sockets of the vibratory device assembly, or to an extension tool 170. Different sockets may be used to allow for different amplitudes. A downward pressure may be created by the boom of the tractor. Two destruction tools may be used simultaneously (not shown). Another embodiment of a different size destruction tool 236 is shown in FIG. 24A.

Figure 24B:
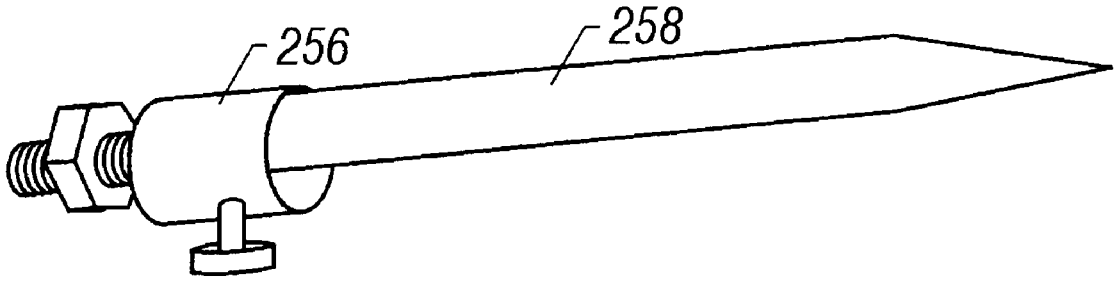
FIG. 24B shows a post and pile driver that may be implemented with an embodiment of the present invention.

In a related embodiment, a post and pile driver is shown in FIG. 24B. The operation of this may be similar to that of the destruction tools. The post and pile driver may be a pole 258 holding device 256 that is mounted to the vibratory device 104 on the main shaft for vibration along with a downward pressure force from the boom of the tractor. In this embodiment, as well as in all other embodiments described herein or evident from this description, the driver may be mounted on either side of the device, or in other locations on the device, for variations of stroke or vibration amplitude and force.

In another embodiment, for pile driving in particular, a variation of the holding device 256 may be used which provides a holding force on the downstroke but not on the upstroke. In this way, the holding device 256 forces the pile into the ground on the downstroke and, on the upstroke, the attachment point of the holding device to the pile is moved progressively higher with each stroke. A suitable cam mechanism can be used for such a holding device 256.

Figure 14A:
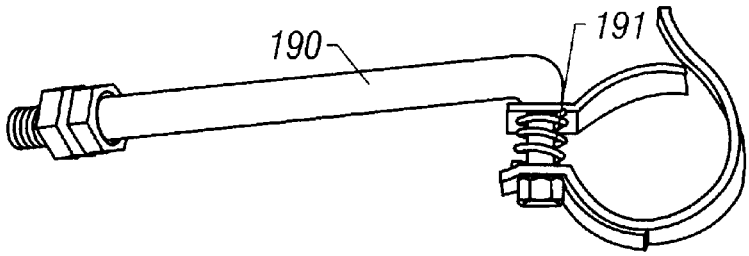
FIG. 14A shows a tree shaker which may be implemented with an embodiment of the present invention.
Figure 14B:
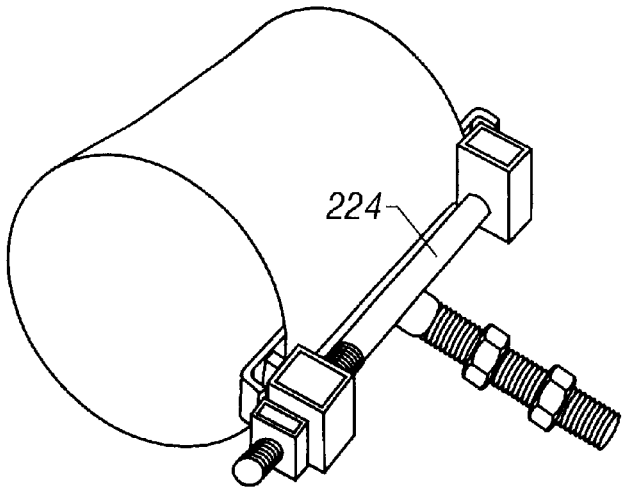
FIG. 14B shows a drum shaker which may be implemented with an embodiment of the present invention.
Figure 14:
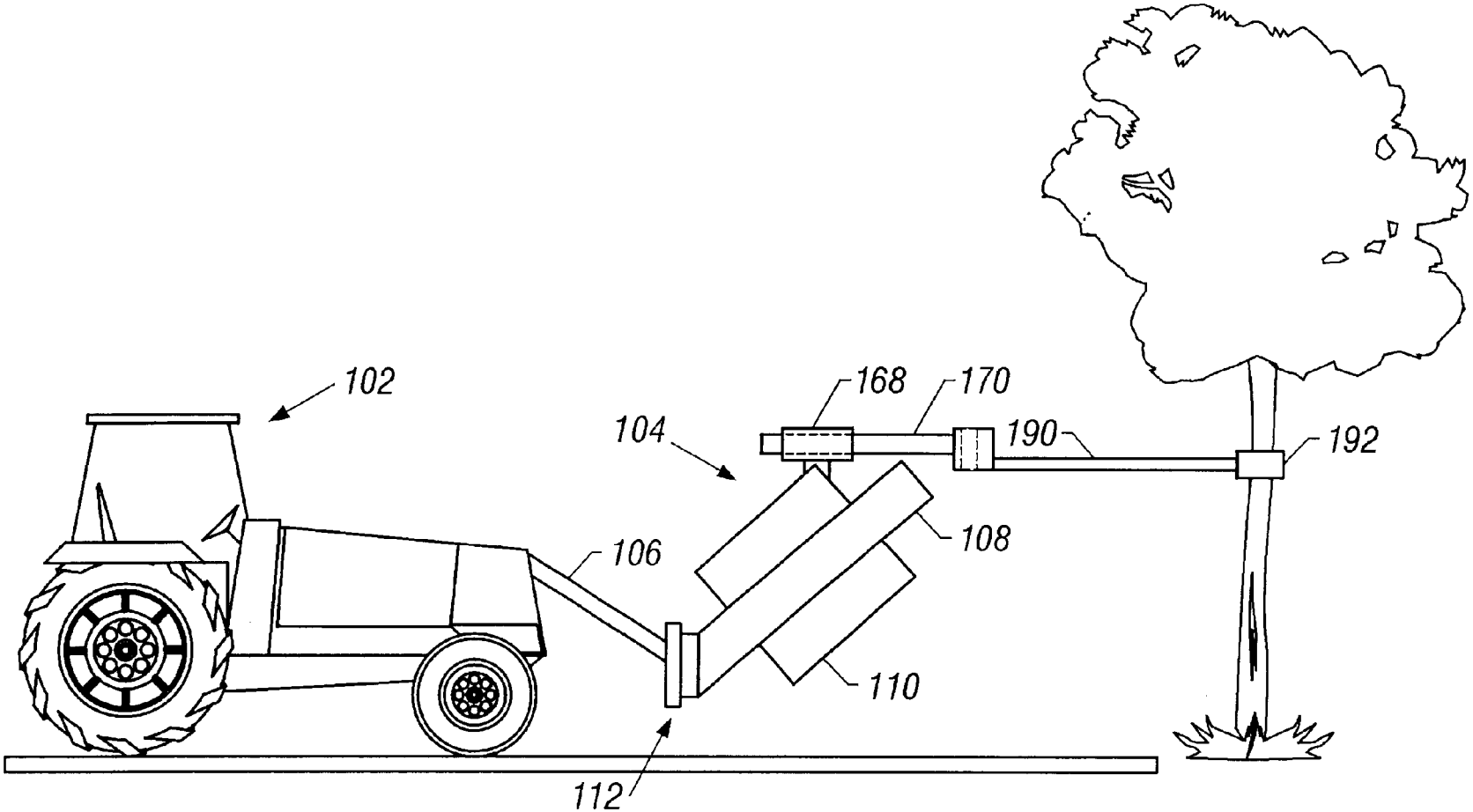
FIG. 14 shows an embodiment of the present invention in which the same is implemented with a tree shaker.

In another embodiment, as shown in FIG. 14, the device may be used as a nut tree shaker. In the nut tree field, there is a need for a device that may be employed to shake the nuts off of a nut tree. The same is true for various fruit trees and berry trees.

The device may be outfitted with an arm 190 that may be screwed into the extension tool 170 on a proximal end and may be attached to the trunk of a nut tree on a distal end via a grip 192 that is of a wrap-around type. By causing the device to vibrate in the manner described above, the nuts on the nut tree may be effectively shaken off. The arm may further contain an overriding spring 191 that compresses to prevent damage to the vibratory device or to the tree (see FIG. 14A).

It will be clear to one of skill in the art that the placement of arm 170 will affect the direction of vibratory motion. For example, in the case of FIG. 14, it would be desired, given the application, to provide a shaking force in a direction parallel to the ground. Thus, arm 170 may be attached at the top of the vibratory box 110 as shown. The same may also be placed at the bottom, i.e., across the diagonal from that shown. Other placements may be used as the circumstance dictates. In fact, in almost all of the drawings, the arm may be placed at various other points on the vibratory box 110 to effect a different type of motion. For this reason, a plurality of sockets may be used in various locations on the vibratory box 110 to allow such connections.

It will be clear to one of skill in the art that by replacing arm 170 with an arm having a larger grip, the device may be made into a barrel shaker. In this case, the larger grip.would attach to a barrel either around the circumference thereof or to the top and bottom ends. Of course, this embodiment.may be used not only for barrels but also for drums, cans, e.g., paint, etc. FIG. 14B shows an example of a barrel shaker 224 that grips a barrel by the top and bottom ends.

Figure 15:
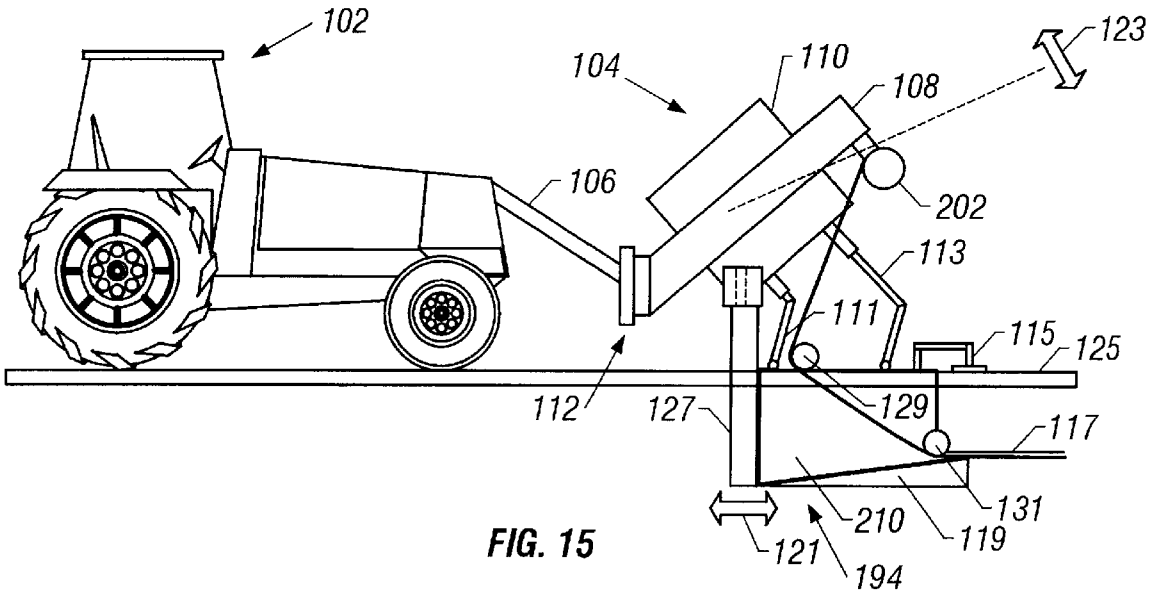
FIG. 15 shows an embodiment of the present invention in which the same is implemented with a cable-laying device.
Figure 16:
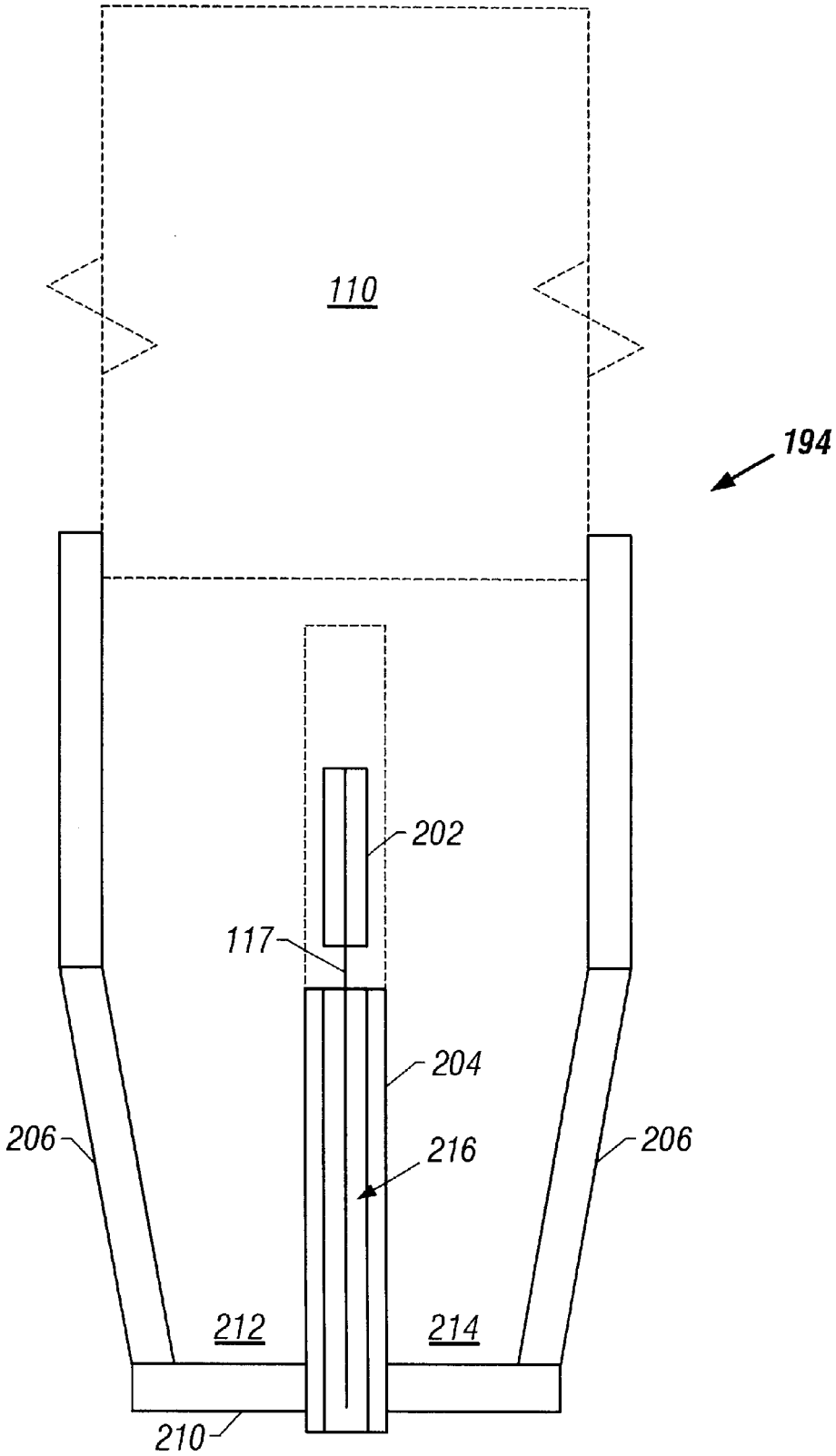
FIG. 16 shows an end-on view of the cable-laying device of FIG. 15.
Figure 16A:
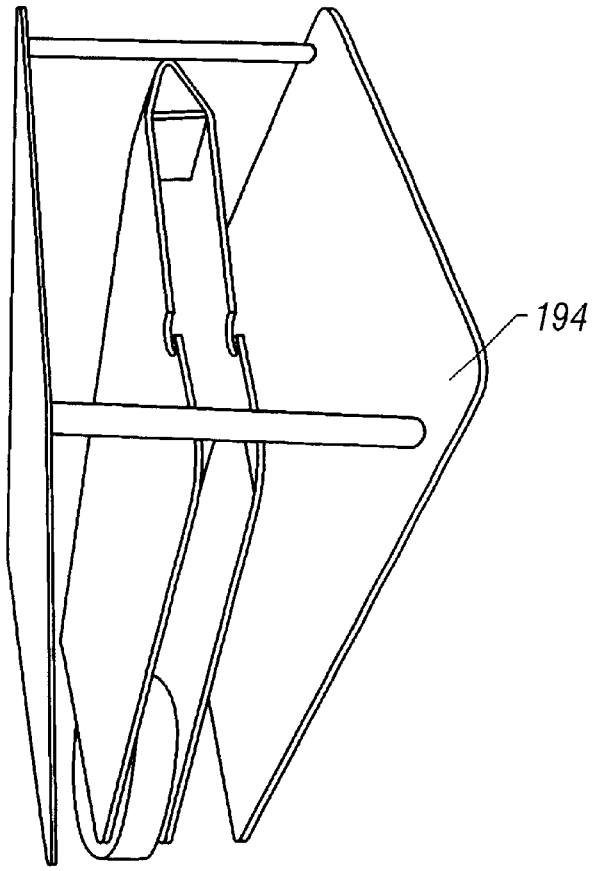
FIG. 16A shows a cable-laying device which may be implemented with an embodiment of the present invention.

In another embodiment, as shown in FIGS. 15, 16, and 16A, a cable-laying device may incorporate the present invention. It should be noted that FIG. 16A is looking at the device from the rear. The central blade may be seen pointing away from the viewer.

Referring in particular to FIG. 16, the cable-laying device 194 has a bottom cutting and guiding piece 210 and two side cutting and guiding pieces 206. A center cutting piece 204 is also employed for splitting the soil. A front blade, such as a trencher blade 127, may be used to cut the soil into a trench shape.

The cable-laying device 194 may be guided into a section of ground 125 in which cable is to be laid. The guiding of the device 194 is assisted by vibration of the vibratory device 104 and the blade 127.

Figure 16B:
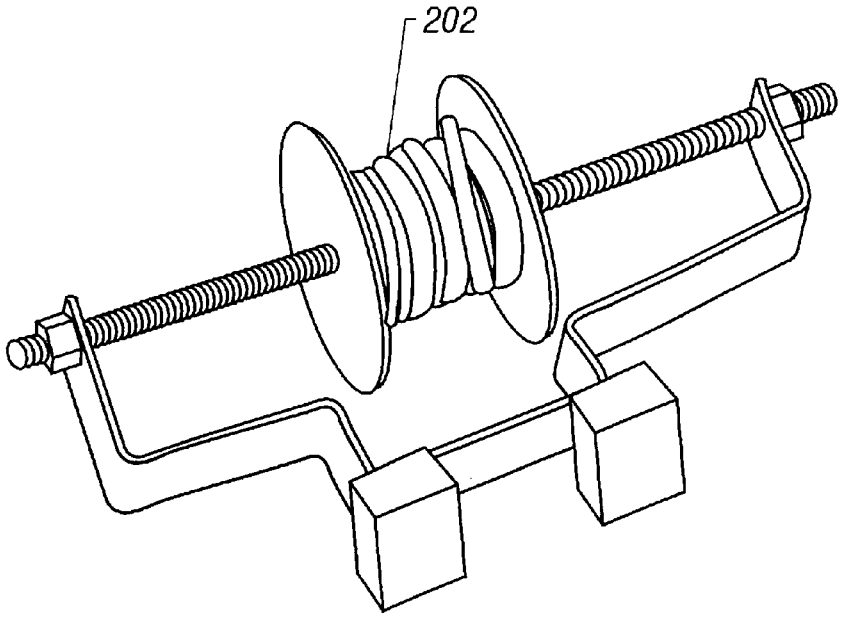
FIG. 16B shows a cable-spool attachment which may be implemented with, e.g., the embodiment of the present invention as shown in FIG. 16A.

The tractor 102 may then be driven backwards (in the figure shown), guiding displaced earth into inclined channels 212 and 214 as the same is cut by blade 127. This also serves to clear a small path between the two channels 212 and 214. In the center of the small path between the two channels 212 and 214 a hollow 216 is provided in which a cable 117 may be disposed as fed off a spool 202 (see also FIGS. 15 and 16B).

In operation, the backward motion of the tractor 102, coupled with the vibration of device 104, feeds earth into channels 212 and 214 and away from the hollow 216. The cable 117 is fed down the hollow 216 from the spool 202 and is so laid between the two channels 212 and 214. As the tractor moves backward, the earth is passed through the channels and back into the trench dug by the blade 127 and the bottom and side cutting and guiding pieces 210 and 206. Tamping may then be employed, if desired, via oscillation of element 194, using an optional tamper 115. The general approximate motion of the vibratory box housing 110 is shown in FIG. 15 by double-headed arrow 123, and the general approximate motion of the cutting blade 127 is shown in FIG. 15 by double-headed arrow 121.

Referring again to FIG. 15, it is seen that an open area 119 may remain after cutting, and a cable 117 may be laid on top of the open area. Two rigid arms 111 and 113 may be employed to assist and to a certain extent direct the motion of the vibratory device 104 to the various cutting surfaces. Referring to FIG. 15, an upper guide pulley 129 and a lower guide pulley 131 may be employed to guide the cable to the proper location in the trench.

It is important to note that the connections of the blade and of the guiding pieces to the vibratory device 104 allow essentially different motions to be performed by each. For example, the blade 127 cuts the soil by being vibrated back and forth in essentially a direction parallel to the ground and perpendicular to the blade edge. On the other hand, the guiding pieces, coupled to the rigid arms, allow a vibratory conveyor effect: the same are lifted up with one vibratory motion direction and, as the tractor moves, the guiding pieces are moved with very little friction to a new location, thus essentially moving the soil carried by the guiding pieces to a new location within the guiding pieces. In other words, the soil is conveyed along the guiding pieces and eventually may exit the guiding pieces or be transported to another location as required.

It is estimated that cable laid in this fashion may be laid at highly enhanced rates compared to conventional techniques. Depending on depth and soil conditions, footage covered may increase 30–50% and in some cases by 200–300%.

Figure 18:
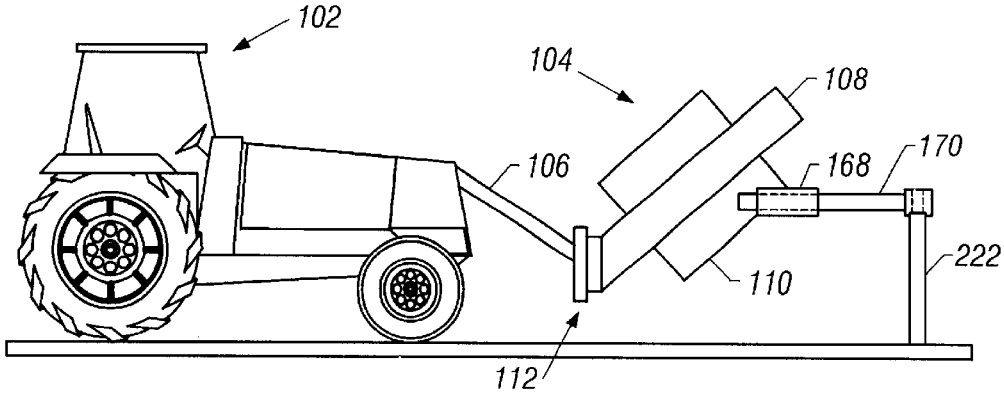
FIG. 18A shows scarifier blades which may be implemented with an embodiment of the present invention.
Figure 18A:
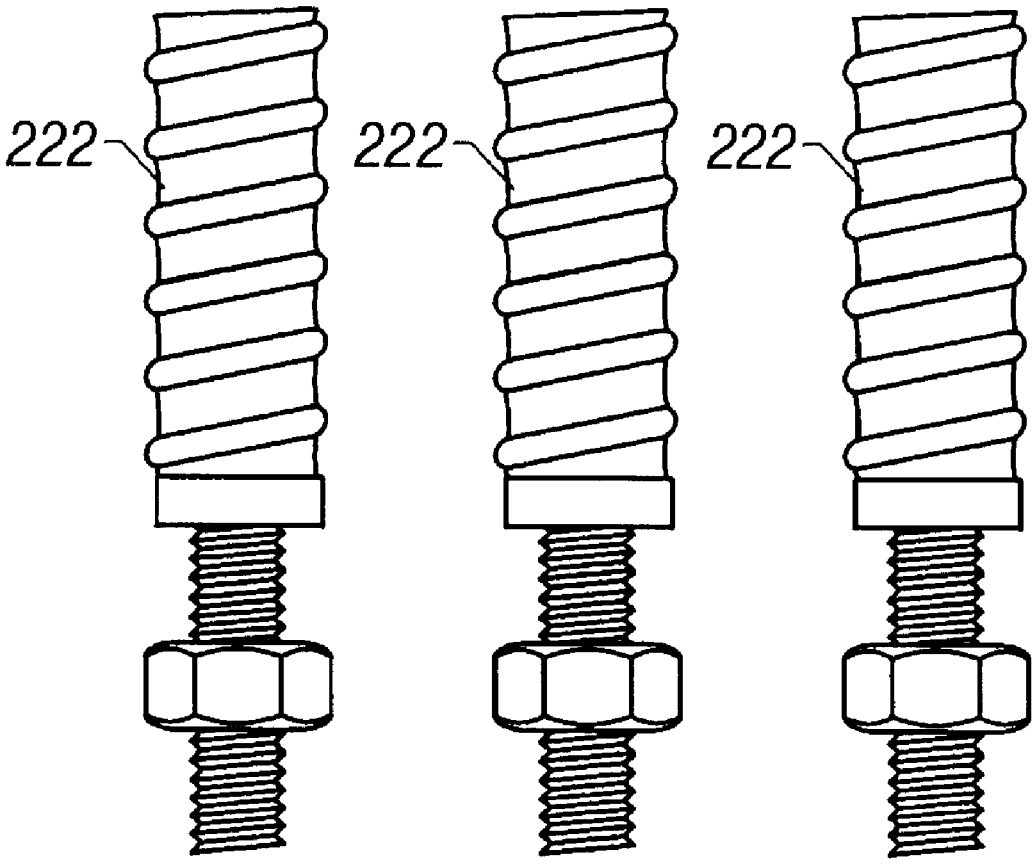

Referring to FIG. 18, a set of scarifier blades 222 may be attached to the extension tool 170. Scarifier blades 222 are especially useful in asphalt cutting and are shaped in a wavy fashion and sharpened on both sides. They may be mounted to-the vibratory device directly (not shown) or through the extension tool. Such blades can cut in both directions of travel. The wavy design, which is shown best by FIG. 18A, when going through an arc due to the pendulum motion, will raise the asphalt slightly and break up the same, making for an easy removal.

Figure 20A:
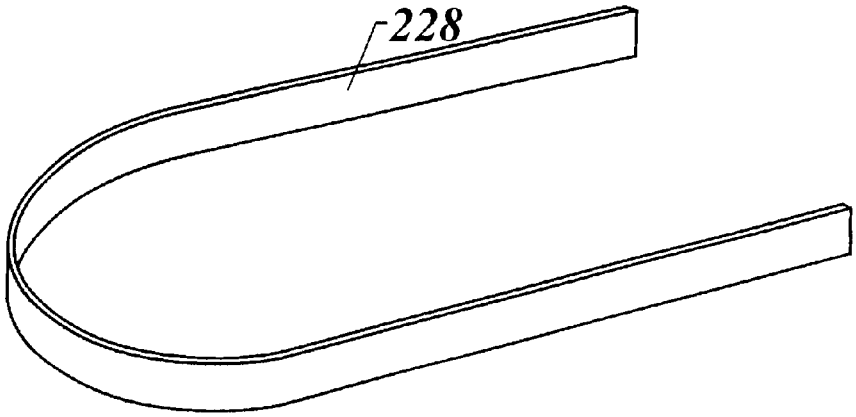
FIG. 20A shows a trencher blade which may be implemented with an embodiment of the present invention.
Figures 1, 19B:
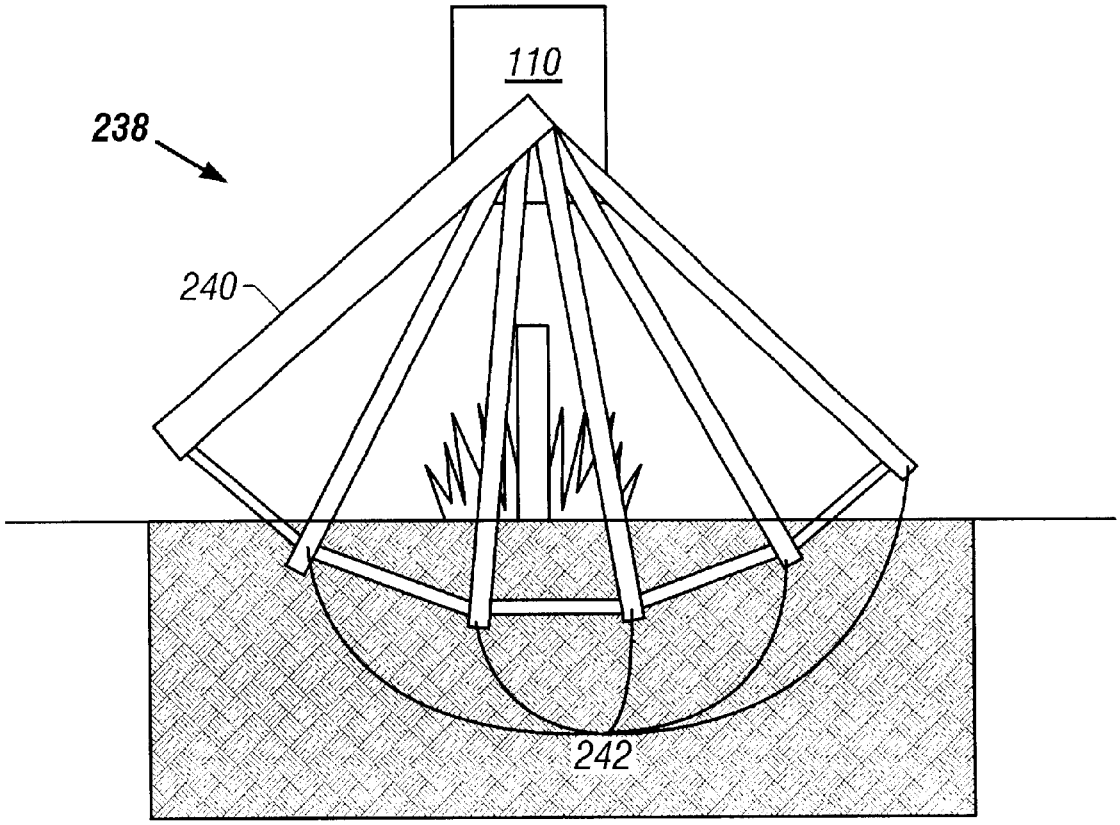

Referring to FIG. 20A, a trencher 228 is shown which may be advantageously employed in combination with the present invention. In particular, the same may be attached to the extension tool 170 and placed in a hole to dig a trench. For example, once placed in the hole, the trencher 228 may be vibrated with the vibratory device 104 in order to provide a cutting action. The vehicle attached to the vibratory device, such as a tractor, may then be moved in the desired trench direction in order to cut the same. If it is not desired to dig a hole in which to place the trencher, the trencher may be attached to a ratchet device (see below) and forced into a section of ground in the same manner as the tree stump remover described below.

It is also noted that the trencher may be the same as the blade 127 in the cable layer of FIGS. 15–16. However, in the trencher, portions of the cable layer device are removed as can be seen in FIG. 20A. The incline and length of the trencher may be increased relative to the cable layer as well in order to, e.g., transfer soil to a surface conveyor (which as is noted herein can be additionally powered by the vibratory device). It will be clear to one of skill in the art that this facility may be used to create a windrow, for example.

Further, depending on the details of the trencher, the same may be used to create an open trench or a closed trench, as dictated by the needs of the user. The trencher may further incorporate other tools, such as a vertical blade, etc.

Figures 1, 20B:
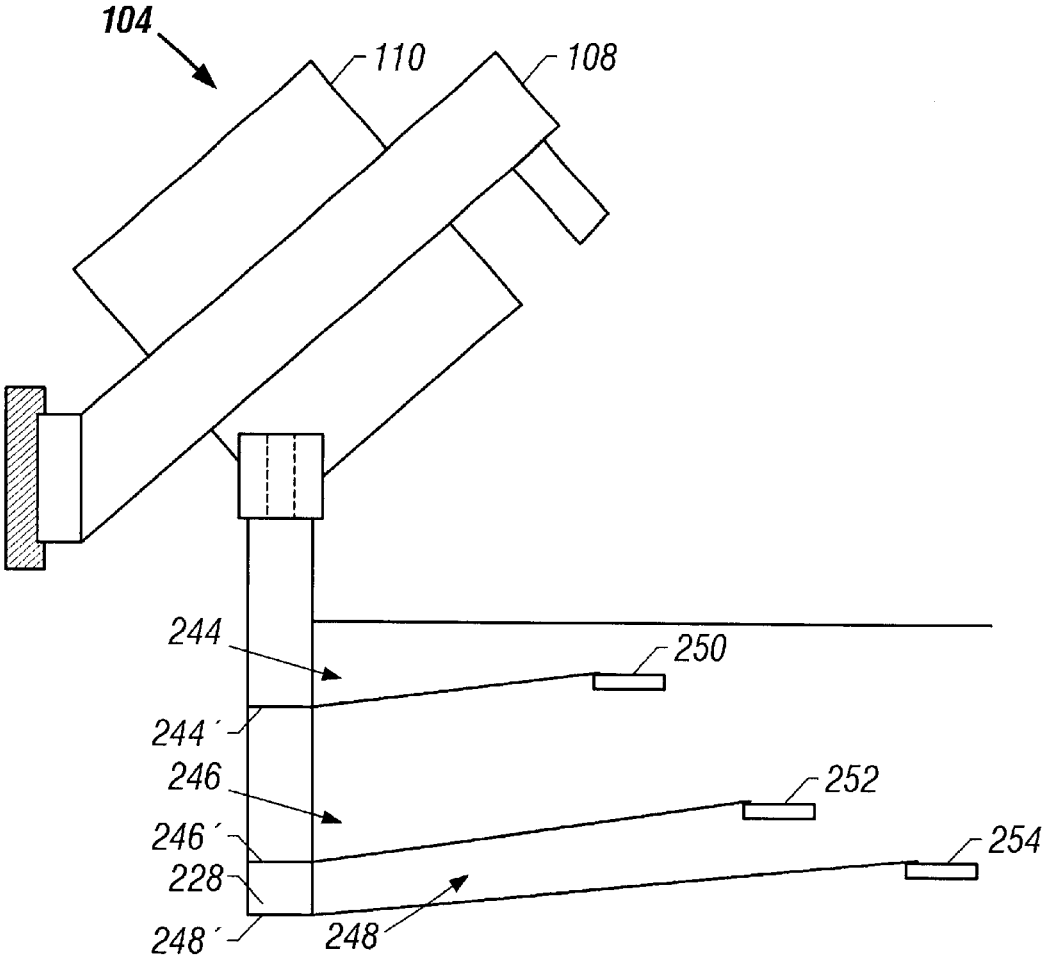
FIG. 20B shows an embodiment, related to the trencher blade, in which soil separation may be achieved, as may be implemented with the present invention.
Figures 2, 20B:
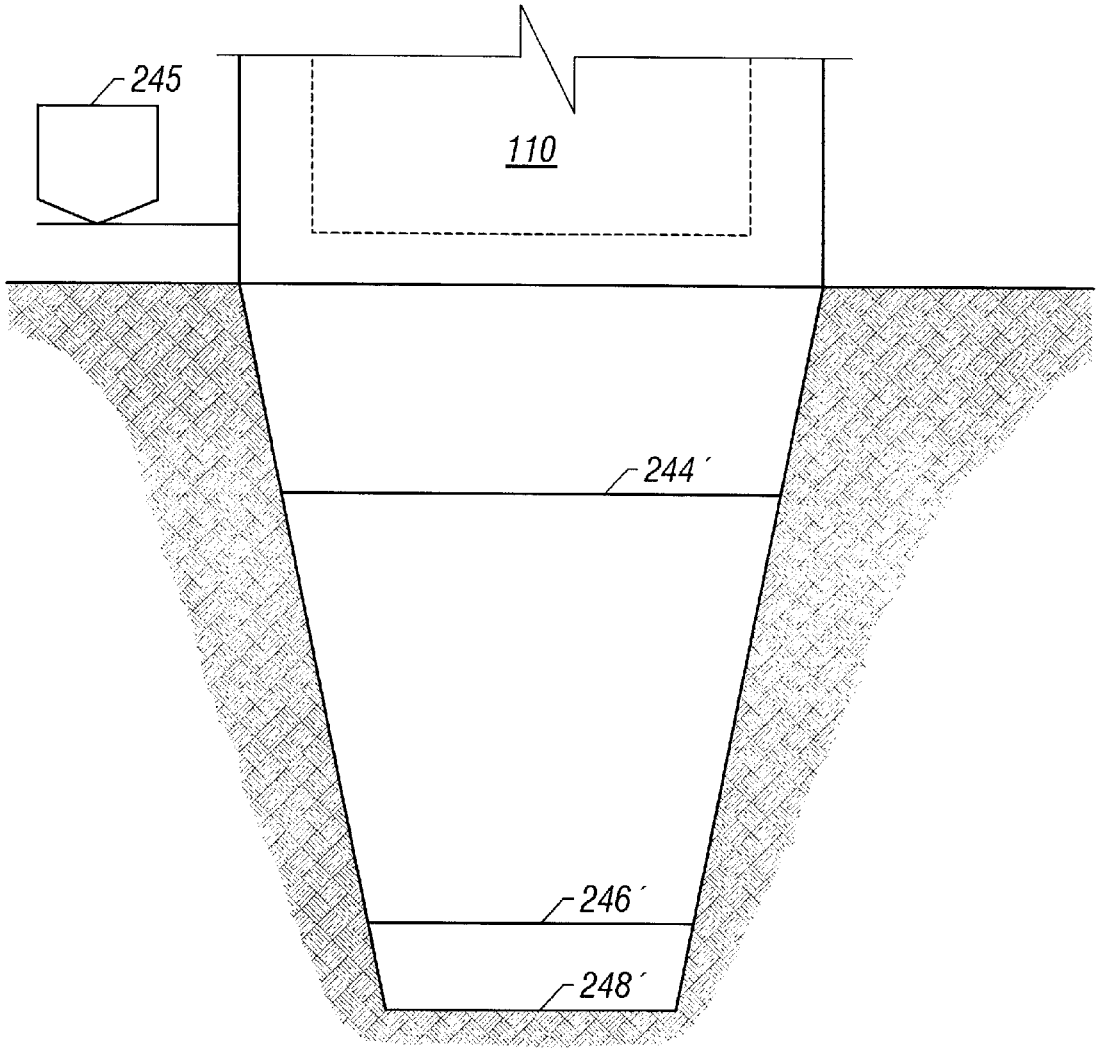

A variation of the trencher is shown in FIG. 20B. This embodiment may be used for separation of materials. As shown, three cuts 244, 246, and 248 may be made by blade 228 and in particular blades 244', 246', and 248'. Such a device may be useful in, e.g., placer mining, where gold samples would generally sink to the bottom. The same may also be useful in sampling various layers of soil. In this embodiment, optional cross-conveyors 250, 252, and 254 may be used to carry material away from each of these cuts, respectively, i.e., in a windrow fashion. In another embodiment, a liquid or gas container may be mounted adjacent the blade 228 for agricultural use, e.g., to introduce fertilizers at the root level underground.

Figure 21A:
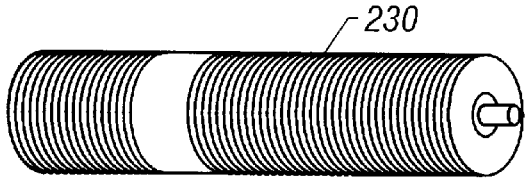
FIG. 21A shows a grid layer spool that may be implemented with an embodiment of the present invention.

Referring to FIG. 21A, a grid layer spool 230 is shown. Grid layer spool 230 may operate in a similar fashion to the vibrating roller described above, except for being placed slightly above the surface. However, grid layer spool 230 may lay down a grid for, e.g., asphalt reinforcement and barrier control.

Tools Employing Ratchets

Figure 13:
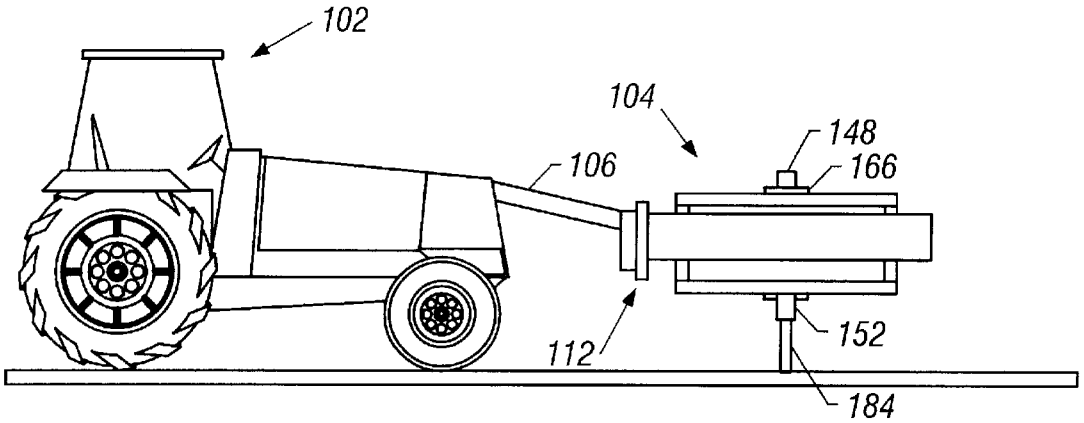
FIG. 13 shows an embodiment of the present invention in which the same is implemented with an auger drill.
Figure 13A:
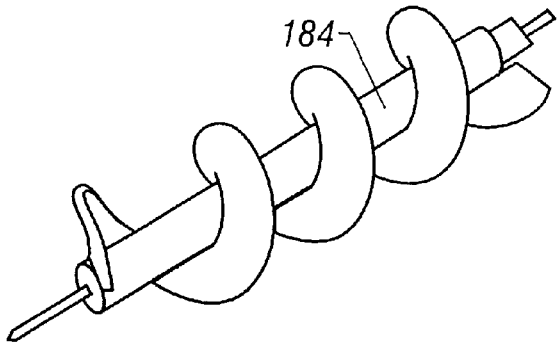
FIG. 13A shows an auger which may be implemented with an embodiment of the present invention.

Referring to FIG. 13, by placing the drive shaft distal end 152 perpendicular to the ground via a swivel as described above and employing the ratchet 166, a vertical boring operation may be performed employing bore 184 (see also FIG. 13A, which shows an auger drill, although operation of a vertical or horizontal bore would be analogous). As noted above with respect to ratchet operations, it is not strictly necessary that the axle of the motor be collinear with the axle of the bore. The same may be offset by way of a gear or a belt.

A horizontal bore may be driven directly from the distal end of the drive shaft 152 so long as the drive shaft is parallel to the ground, such as is shown in FIGS. 1–3, 5, and 8. However, in these figures, the power of the tractor may have difficulty in pushing the bore forward since the bore is rotating at right angles to the direction of movement of the tractor. In this case, it is preferable to use the swivel of FIG. 6 to rotate the drive shaft distal end 152 such that the same is parallel to both the ground and the direction of movement of the tractor.

Both vertical and horizontal boring tools may employ a quick-coupling at the drive shaft or elsewhere to affix the vibratory device after location of the plumb position or a point relative thereto. The ratchet device may also be used to perform or help perform the rotation.

Figure 25:
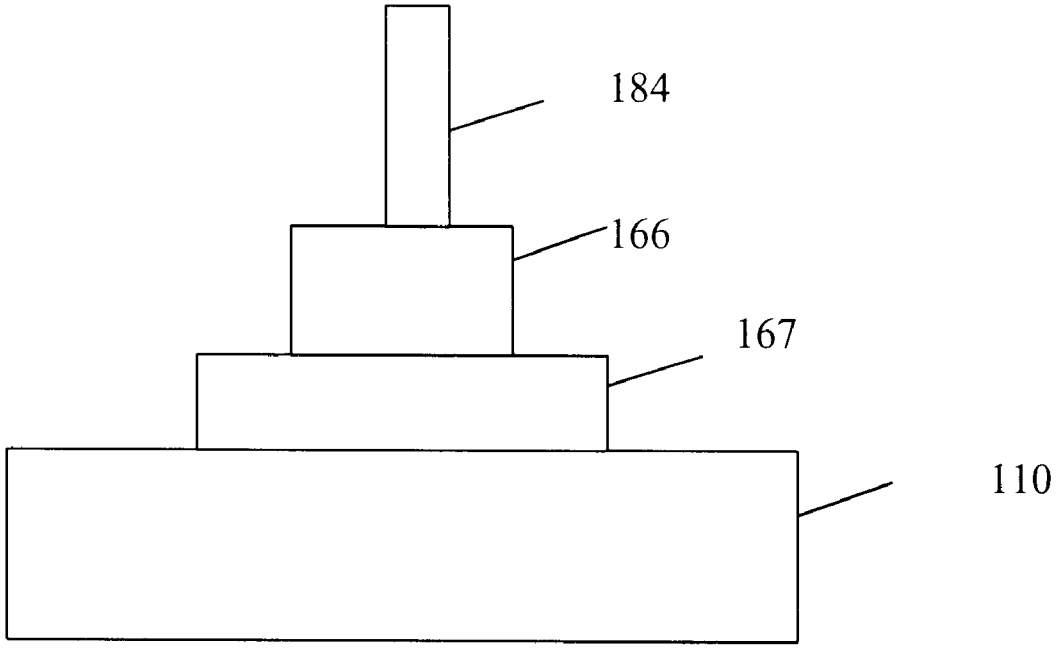
FIG. 25 shows a ratchet mounted on a housing via a socket, with a tool attached.

FIG. 25 shows a ratchet 166 mounted on a housing 110 via a socket 167, with a tool 184 removably attached.

In this same configuration, the device may be employed as a commercial pipe cleaner. However, in this embodiment, the horizontal bore is replaced with a commercially available pipe cleaner, i.e., a large cylindrical brush. By moving the tractor in a forward and backward direction, cleaning of a commercial pipe may be accomplished in a longitudinal direction. By the rotational motion of the ratchet, the commercial pipe cleaner may be caused to rotate and clean a pipe in an azimuthal direction. Of course, it will be clear to one of ordinary skill in the pipe cleaning art that this system may also be employed in the absence of a ratchet. That is, the back and forth motion of the tractor, coupled with the vibration, may be enough to clean the pipe per se.

Figure 17:
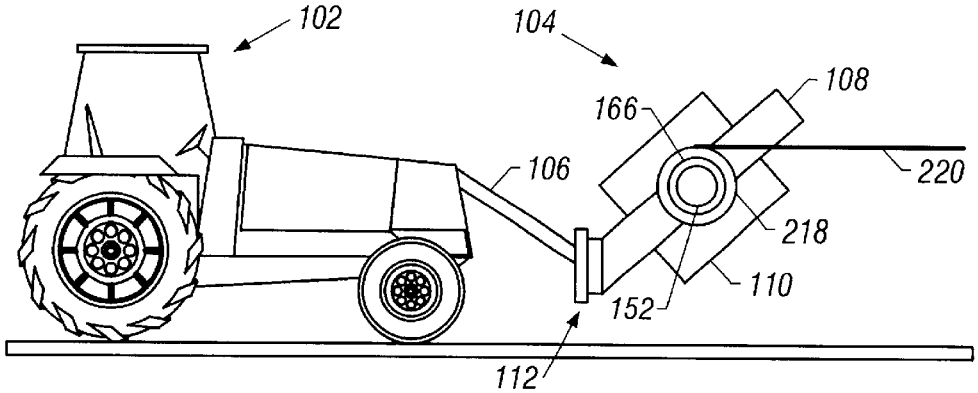
FIG. 17 shows an embodiment of the present invention in which the same is implemented with a winch.

Referring to FIG. 17, an embodiment of the invention showing a winch is illustrated. Drive shaft 152, driving ratchet 166, is shown directly connected to winch 218 having a rope 220. The winch 218 may be rotated using the motion of the vibratory device 104 in combination with the ratchet 166 as described above. The winch may be a standard pulley and may be made for easy mounting. The same may be wound in either direction, and may preferably be designed to not "free wheel". It will be clear to one of skill in the art, given the teaching of this specification, that various other wheeled devices may be operated similarly, including a conveyor, etc.

Figures 2, 19B:
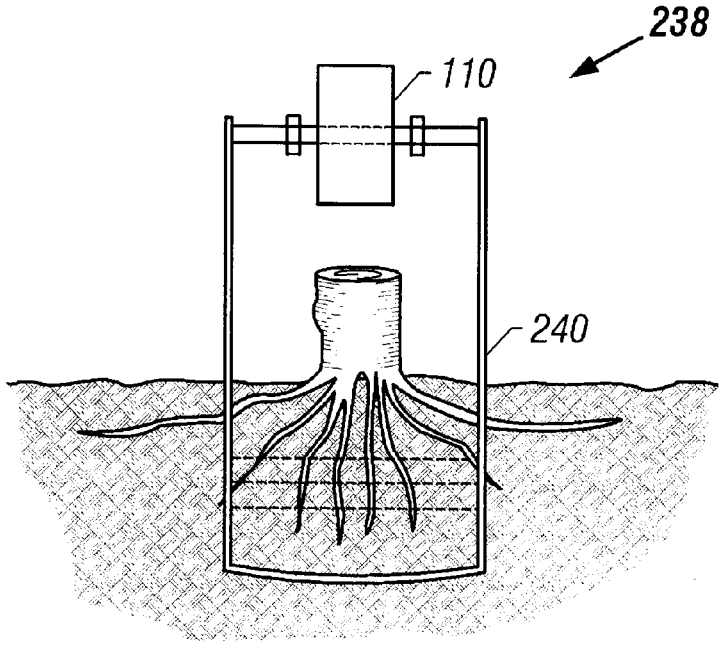
FIG. 19B shows an alternate embodiment of a stump removal blade which may be implemented with an embodiment of the present invention.
Figure 19A:
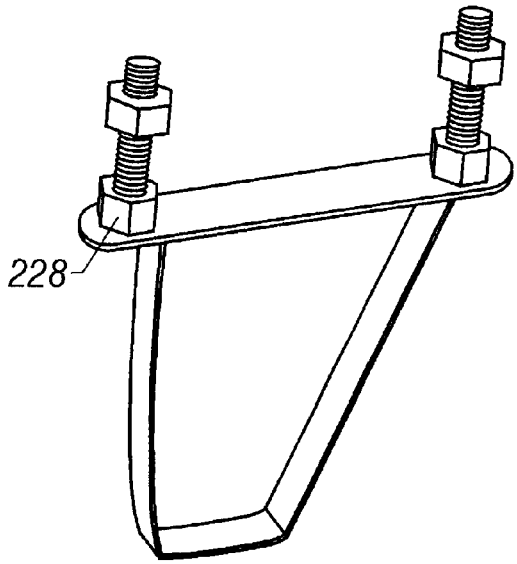
FIG. 19A shows a stump removal blade which may be implemented with an embodiment of the present invention.

Referring to FIG. 19A, a blade 226 which may be used for stump removal in combination with an embodiment of the invention is illustrated. A blade 226 is shown which may be mounted such that each connection point 228 is on an opposite side of the vibratory device 104. By having each connection point 228 connect to the ratchet 166, a powerful rotation force can be established. By placing the blade 226 such that the same essentially surrounds the tree stump, for example, and operating the vibratory device 104 with ratchet 166, the blade 226 can be made to enter a spot of ground and cut underneath a tree stump. Of course, other uses may also be envisioned besides tree stump removal.

An enhanced version of this embodiment is seen in FIG. 19B. In FIG. 19B, a stump remover 238 is shown. Stump remover 238 includes a main cutter blade 240 and a series of, e.g., five, fan blades 242. The main cutter blade 240 acts as above. The fan blades 242 may follow the main cutter blade and act as a net to hold the stump and roots in place. The tractor boom, by raising the vibratory device 104, may also then raise the stump and the roots from the ground.

In either case, the stump remover may rigidly mount to the ratchet and the main shaft.

The main blade may be made of, e.g., alloy metals in the 300,000 psi class. The same may also be thin, e.g., approximately ⅜" and sharpened on one side and of a length and width sufficient to cut roots on the side and bottom end of the stump and below the stump as the cutter vibrates through the cut. The ratchet assembly may contain a regular pulley or a cog pulley in order to drive the second shaft by continuous RPM or by intermittent ratcheting RPM.

Figure 23A:
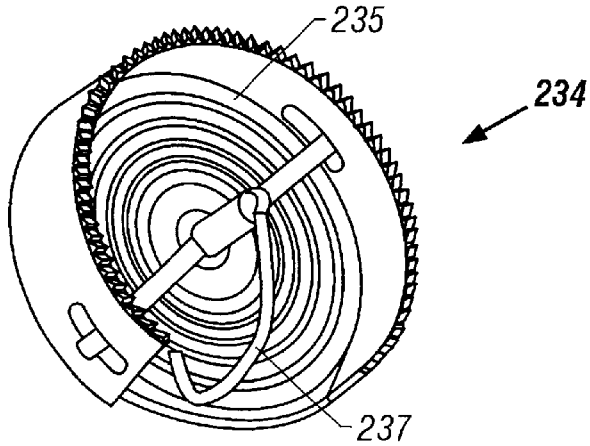
FIG. 23A shows an asphalt circle cutter that may be implemented with an embodiment of the present invention.

Referring to FIG. 23A, an asphalt circle cutter 234 is shown. Asphalt circle cutter 234 may employ a cutting blade 235 as well as a shield 237 for deflecting cut asphalt away from the cutter 234. The operation of asphalt circle cutter 234 may be that the same is disposed on the ratchet 166 where the shaft of ratchet 166 is vertically mounted. By placing the cutter 234 over the area to be cut, and lowering the cutter 234 to the asphalt, a well-defined circle may be cut and the asphalt removed. In another embodiment, the asphalt circle cutter may be used without the ratchet 166.

It will be understood that the above description of a "Method and Apparatus for Vibratory Kinetic Energy, Generation and Applications Thereof" has been with respect to particular embodiments of the invention. While this description is fully capable of attaining the objects of the invention, it is understood that the same is merely representative of the broad scope of the invention envisioned, and that numerous variations of the above embodiments may be known or may become known or are obvious or may become obvious to one of ordinary skill in the art, and these variations are fully within the broad scope of the invention. For example, the vibratory box 110 may take on a number of different constructions and arrangements. The term "tractor" as used herein is to mean not only the common definition but also indeed any vehicle capable of carrying the vibratory device.

Accordingly, the scope of the invention is to be limited only by the claims appended hereto, and equivalents thereof. In these claims, a reference to an element in the singular is not intended to mean "one and only one" unless explicitly stated. Rather, the same is intended to mean "one or more". All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present invention is intended to be dedicated to the public regardless of whether the element, component, or method step is explicitly recited in the claims. No claim element herein is to be construed under the provisions of 35 U.S.C. §§112, ¶6, unless the element is expressly recited using the phrase "means for".

What is claimed is:

1. A method for performing a series of tasks employing vibration of a tool, comprising:

Providing a housing containing at least one off-center weight, the off-center weight coupled to a motor and configured to rotate or revolve to vibrate the housing, Removably mounting the housing via a device mount to a mount on a vehicle;

Removably mounting a tool to a ratchet on the housing via a socket on the housing, to perform a task;

Providing a removable leaf-spring system, including:

A leaf spring coupled to the housing; and

At least two points between which the leaf spring may oscillate; and

Rotating or revolving the off-center weight, wherein the rotating or revolving the off-center weight causes the leaf spring to oscillate between the at least two points;

Removing the tool from the ratchet;

mounting a different tool to the ratchet, to perform a different task; and

Rotating or revolving the off-center weight.

2. The method of claim 1, wherein the tool is selected from the group consisting of: bores, augers, cable layers, trenchers, blades, shakers, rollers, planars, grinders, tillers, rakes, tampers, grid layers, scarifiers, conveyors, winches, scrapers, mixers, shaker screens, corers, destruction tools, drills, cutters, double line cutters, pipe cleaners, and combinations thereof.

* * * * *